US011266902B2

(12) United States Patent
Hohnecker

(10) Patent No.: US 11,266,902 B2
(45) Date of Patent: Mar. 8, 2022

(54) ROBOTIC DEVICE AND METHOD FOR SETTING UP AT LEAST ONE BOWLING PIN

(71) Applicant: PIN MARKETING SL, San Fernando (ES)

(72) Inventor: Sven Hohnecker, San Fernando (ES)

(73) Assignee: PIN MARKETING SL, San Fernando (ES)

( * ) Notice: Subject to any disclaimer, the term of this patent is extended or adjusted under 35 U.S.C. 154(b) by 0 days.

(21) Appl. No.: 16/760,120

(22) PCT Filed: Jul. 12, 2018

(86) PCT No.: PCT/EP2018/069050
§ 371 (c)(1),
(2) Date: Apr. 29, 2020

(87) PCT Pub. No.: WO2019/086150
PCT Pub. Date: May 9, 2019

(65) Prior Publication Data

US 2020/0254328 A1 Aug. 13, 2020

(30) Foreign Application Priority Data

Nov. 2, 2017 (EP) ..... 17199791

(51) Int. Cl.
*A63D 5/08* (2006.01)
*A63D 5/02* (2006.01)
*A63D 5/10* (2006.01)

(52) U.S. Cl.
CPC ..... *A63D 5/08* (2013.01); *A63D 5/02* (2013.01); *A63D 5/10* (2013.01)

(58) Field of Classification Search
CPC ..... A63D 5/02; A63D 5/08; A63D 5/10
USPC ..... 473/65
See application file for complete search history.

(56) References Cited

U.S. PATENT DOCUMENTS 6,027,411 A 2/2000 Huhne
6,524,192 B1 2/2003 Tsujita et al.
2006/0211508 A1 9/2006 Speigl

FOREIGN PATENT DOCUMENTS

CN 204469183 U 7/2015
CN 107096211 A 8/2017
(Continued)

OTHER PUBLICATIONS

Robotics Online, Robotics+Vision at a Glance:The Dos, Don'ts and Applications, by Tanya M. Anandan, https://www.robotics.org/content-detail.cfm/Industrial-Robotics-Industry-Insights/Robotics-Vision-at-a-Glance-The-Dos-Don-ts-and-Applications/content_id/4189, Jul. 2013.*
(Continued)

*Primary Examiner* — William M Pierce
(74) *Attorney, Agent, or Firm* — Studebaker & Brackett PC

(57) ABSTRACT

An appliance for setting up at least one bowling pin. The appliance includes an object recognition device for detecting the bowling pin and an orientation of the bowling pin, wherein the orientation of the bowling pin encompasses a vertical orientation and a horizontal orientation of the bowling pin, at least one robot arm which is designed for gripping and holding the bowling pin and for setting up the bowling pin onto a predefined desired position and a control unit which is designed to evaluate data of the object recognition device and to activate the robot arm in dependence on the predefined desired position of the bowling pin and/or on the detected orientation of the bowling pin.

20 Claims, 7 Drawing Sheets

(56) References Cited

FOREIGN PATENT DOCUMENTS

Figure 1:
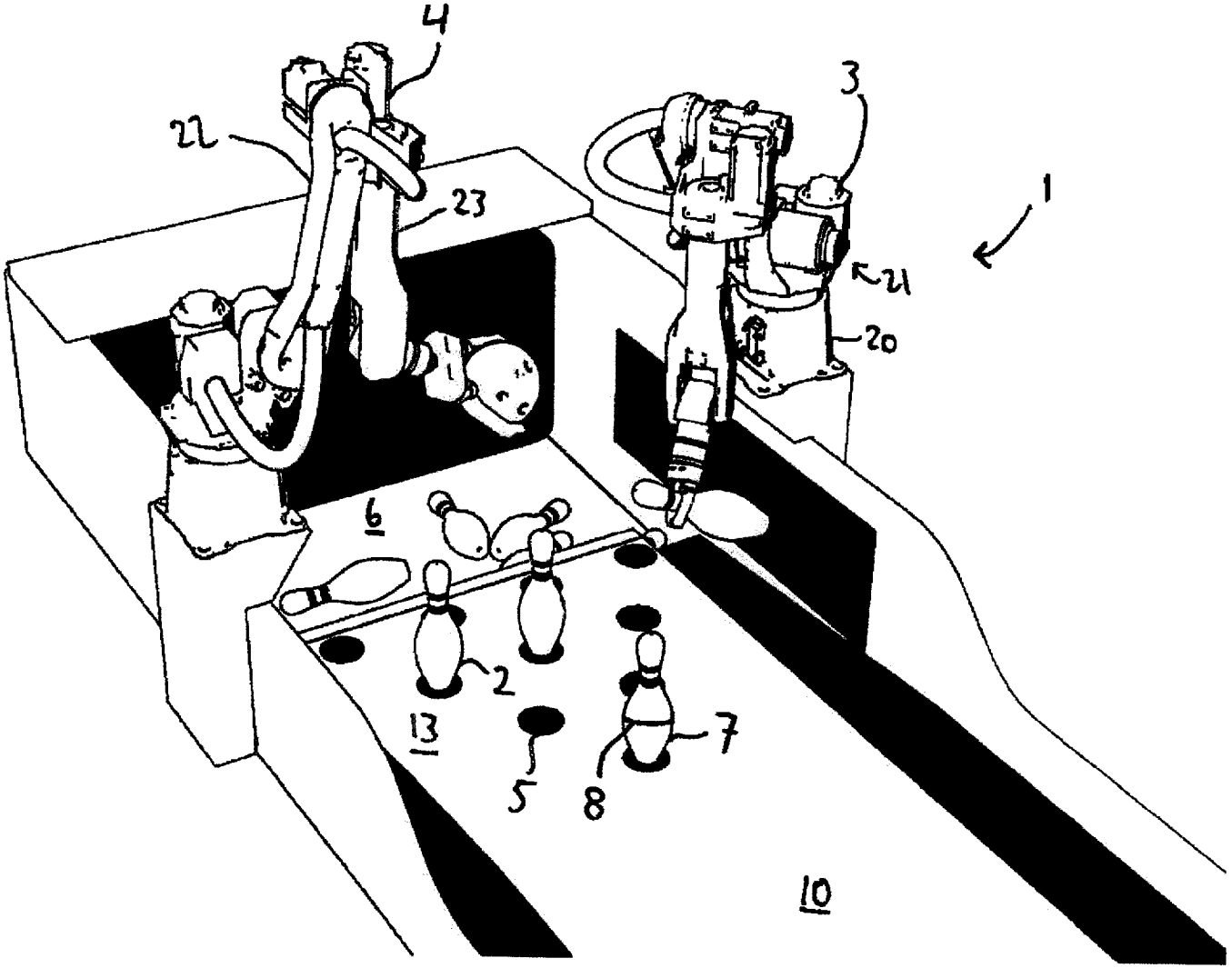

| | | | |
|---|---|---|---|
| EP | 1002558 | A2 | 5/2000 |
| JP | H06-182021 | A | 7/1994 |
| JP | H11139558 | A | 5/1999 |
| JP | 2007014511 | A | 1/2007 |
| NL | 2003002 | C2 | 12/2010 |
| WO | 2012/091550 | A1 | 7/2012 |

OTHER PUBLICATIONS

Set Em' Up! Knock Em' Down! Bowling's Automated Pin Technology, https://invention.si.edu/set-em-knock-em-down-bowling-s-automated-pin-technology ,Aug. 2013.*

Mobile Robots from KUKA, https://web.archive.org/web/20170606223228/https://www.kuka.com/en-us/products/mobility/mobile-robot-systems, Jun. 2017.*

Linear Motion Tips, Designing (seventh-axis) linear motion tracks for robotic positioning, https://www.linearmotiontips.com/designing-linear-motion-tracks-robotic-positioning/, by Lisa Eitel, May 2016.*

Sensors: Robot Guidance Using Machine Vision Techniques in Industrial Environments: A Comparative Review, by Luis Perez et al. www.pdpi.com/journal/sensors, 2016.*

International Search Report issued in PCT/EP2018/069050; dated Oct. 24, 2018.

An Office Action; "Notice of Reasons for Rejection," issued by the Japanese Patent Office dated Sep. 17, 2021, which corresponds to Japanese Patent Application No. 2020-544105 and is related to U.S. Appl. No. 16/760,120.

* cited by examiner

ROBOTIC DEVICE AND METHOD FOR SETTING UP AT LEAST ONE BOWLING PIN

The invention relates to an appliance, to a bowling system as well as to a method for setting up bowling pins, wherein a robot arm is designed to place the bowling pins onto a predefined position.

Different types of appliances for setting up bowling pins are known from the state of the art. Such devices are sometimes called pinsetters and should be capable of placing e.g. a multitude of toppled bowling pins back upright onto a predefined position within less than 30 seconds.

The disadvantages with these known appliances are the relatively rapid wearing of individual components and the extensive maintenance of the appliances, by which means the appliances are often prone to malfunctioning. Furthermore, as a rule, replacement parts need to be constantly bought and exchanged for a trouble-free operation of a bowling lane. As a whole, the maintenance of such appliances for positioning the bowling pins is costly and time-consuming. Given a failure of the pinsetter, in most cases the associated bowling lane cannot brought back into operation and used again until the point in time of remedying the cause or completion of the repair. Furthermore, existing pinsetters have a high weight of up to 1000 kg or even more. Furthermore, existing pinsetters cause considerable noise, which significantly restricts their locations.

Until now, concerning setting-up appliances of the state of the art, it has not been possible to set arbitrary pin setups on a bowling lane in a manner which is simple for the user and to let this be carried out by the setting-up appliance.

Furthermore, it has been found to be difficult to place pins which have been left standing but displaced after a throw back onto the lane in this selfsame displaced position after the fallen pins have been cleared away.

In the publication U.S. Pat. No. 6,524,192 B1, bowling pins are received by a multitude of gripper pincers and are subsequently set up onto predefined positions.

The publication WO 2012/091550 A1 describes an appliance for setting up bowling pins, wherein the bowling pins are fastened to pulleys by way of cables. Furthermore, detection means which are capable of detecting a movement of the bowling pins are provided.

The document U.S. Pat. No. 6,027,411 A discloses an appliance for setting up bowling pins which can be brushed from the bowling lane by way of a pusher. The bowling pins are placed back onto the bowling lane again by way of a comparatively complicated mechanism.

The publication US 2006/0211508 A1 further shows an electromechanical device with a hydraulic drive for setting up bowling pins.

It is the object of the invention to at least partly overcome the problems of the state of the art.

An appliance for setting up at least one bowling pin is put forward by the present document. The device comprises:

an object recognition device for detecting the bowling pin and an orientation of the bowling pin, wherein the orientation of the bowling pin encompasses a vertical orientation and a horizontal orientation of the bowling pin, at least one robot arm which is designed for gripping and holding the bowling pin and for setting up the bowling pin onto a predefined desired position, and a control unit which is designed to evaluate data of the object recognition device and to activate the robot arm in dependence on the predefined desired position of the bowling pin and/or on the detected orientation of the bowling pin.

In comparison to the known appliances of the state of the art, the suggested appliance for setting up bowling pins is typically characterised by its compact, energy-saving and lightweight construction manner Whereas until now complicated and large machines were required for setting up bowling pins, the suggested appliance can make do with only one object recognition device, one robot arm and one control unit.

Furthermore, the bowling pins can be set up onto the predefined desired position with a high precision by way of the robot arm. Typically, in the case of a bowling game, ten bowling pins are arranged in an isosceles triangle or equilateral triangle, wherein an apex of the triangle points in the direction of the bowling player. A large flexibility on setting up the bowling pins can be achieved due the fact that the robot arm is used for setting up the bowling pins. For example, a multitude of bowling pins can be placed on the lane in a predefined arrangement. The bowling pins can therefore be arranged in the most varied of geometric shapes. For example, nine bowling pins can be set up in a square. Alternatively, the bowling pins can also be set up for example along a line. The predefined arrangement can be a complete basic set-up of e.g. ten in a triangle or nine bowling pins in a square or a partial set-up of these arrangements. Furthermore, the bowling pins can be arranged on lane in a manner different from the triangular shape or square shape by way of the suggested appliance. The number of bowling pins can hereby be 9 or 10 or also greater than 10 or smaller than 9. The suggested appliance therefore permits arbitrary predefined desired positions and arrangements of the bowling pins on the lane, by which means even new game types which were hitherto not possible with the previous setting-up appliances can be conceived.

The region of the lane, in which the bowling pins are set up, is often called a pindeck. The predefined position of the bowling pin or the predefined arrangement of the bowling pins or the number of bowling pins can be specified e.g. by a user via an input means which is connected to the control unit. If a user e.g. wishes to practice his throwing technique given certain arrangements of bowling pins, he can then input or change the predefined position of the bowling pin or the arrangement of the bowling pins or the number of bowling pins via the input means.

The suggested appliance further permits a rapid set-up of the bowling pins, i.e. the appliance ensures a set-up within 30 seconds or less. In a preferred embodiment, the robot arm at the most weighs 200 kg or at the most 175 kg or at the most 150 kg.

A bowling pin the context of this document is to be understood as cone-shaped, cylinder-shaped and/or rod-shaped objects which are typically toppled by a user by way of a ball. The applied term "bowling pin" therefore amongst other things includes a "pin", "skittle", "bowling skittle" and "bowling pin". The bowling ball is often simply called ball. If a bowling pin is in the horizontal orientation, then this can also be termed as a "toppled bowling pin". If a bowling pin has the vertical orientation, then this can be termed as a "bowling pin left standing".

A bowling lane typically comprises an approach, a foul line, a lane (run surface), a pindeck, a pit and/or at least one gutter.

Hereby, the approach is the region, in which the players move, in order to carry out their throw. The foul line is usually a line which is marked in black and which delimits the approach and the lane from one another. The foul line is often connected to a control unit by a light barrier. If the light barrier is triggered, then an F (foul) is registered and the toppled pins do not count. The lane is the mostly 60 feet long region between the approach and the pindeck. This region is not usually stepped on by the players. The ball runs through this region on its path to the pins which stand on the pindeck. The lane is usually oiled in regions, in order first and foremost to protect the coating of the lane. The pindeck is the region, in which the bowling pins stand or in which toppled over bowling pins are set up again. The pit connects to the region of the pindeck in the longitudinal direction. The pit is the region, into which the toppled bowling pins are pushed by a pusher or into which the bowling pins are knocked by the ball. The at least one gutter extends laterally (to the right or left) next to the lane and the pindeck.

In a further development, the object recognition device is designed for detecting a position of the bowling pin. In particular, the detected position includes a position of the bowling pin having a horizontal orientation. The precise position of a bowling pin which has the horizontal orientation under certain circumstances does not need to be detected. Optionally however, the position of the bowling pin which has the horizontal orientation can also be detected by the object recognition device. A position of the bowling pin can be understood for example as a projection of a position of the centre of gravity of the bowling pin onto a plane surface such as a lane or bowling lane or pit (see below). Whereas therefore the orientation of the bowling pin provides information as to whether the bowling pin is standing or is lying, the position of the bowling pin specifies where the bowling pin is located on the lane or in the pit (see below).

The control unit can be designed to activate the robot arm in dependence on the detected position of the bowling pin. The detected position can encompass the predefined desired position and/or an actual position which is horizontally displaced with respect to the desired position.

Typically, a bowling player or user has two throws, in order to topple a number of bowling pins (mostly ten). It can occur that a bowling pin is displaced from its original position by the first throw without toppling. However, before the second throw, the bowling pin should stand where it was pushed to with the first throw. Given the second throw, one can ensure that the bowling pin is placed precisely to where it has been displaced to after the first throw or remains precisely there, due to the fact that the control unit is capable of activating the robot arm in dependence on the detected position of the bowling pin. Currently available pin setters such as cable pin setters do not achieve this or not in a satisfactory manner or only within a relatively large tolerance range.

The appliance can further comprise a pusher. The pusher can be designed to push a multitude of bowling pins which are located for example on the lane, into a pit, for example into a gutter.

It is briefly explained hereinafter as to how, as a rule, the bowling pins are pushed from the lane (the pindeck) and into the pit by way of a pusher according to the state of the art. As soon as the first bowling ball has been pushed/thrown and some bowling pins still stand after the first throw of the bowling ball, usually pincers drop downwards and grip the remaining bowling pins. The pincers pull up the bowling pins and the pusher pushes the toppled-over bowling pins which is still lie on the lane to the rear, into the pit. The bowling pins are subsequently placed onto the lane or onto the pindeck by the pincers and the empty pincers move upwards again. After the second throw, the pincers also move down again, but do not grasp for the bowling pins but go up again. The pusher subsequently pushes the last bowling pins from the second throw to the rear, into the pit. Inasmuch as a lying bowling pin is located on the pindeck or in the gutter, this is pushed into the pit by the pusher. The second throw can be effected immediately, inasmuch as no bowling pin lies on the pindeck or in the gutter.

In contrast to this, according to an embodiment example of the present application, after the first throw, all bowling pins on the lane, thus toppled as well as standing bowling pins are pushed into the pit by way of the pusher. In an embodiment, the control unit is designed to activate the pusher and the robot arm in a manner such that if a first number of bowling pins has the horizontal orientation, the pusher pushes all bowling pins including a second number of vertically orientated bowling pins into the pit.

The robot arm can for example only grasp the second number of vertically oriented bowling pins out of the pit and set them up onto the predefined desired position or onto the position which is detected by the object recognition device. Hereby, as a rule, it is not a question of which bowling pins are gripped out of the pit by the robot arm and placed back up onto the lane (onto the pindeck); it is only the number of bowling pins which has remained standing after the first throw which are set up again.

It has been found that e.g. after the first throw, it is simpler to push all bowling pins from the lane into the pit, to thereafter grasp individual bowling pins out of the pit by way of the robot arm and to subsequently set them up, than to grasp toppled bowling pins between still standing bowling pins by way of the robot arm and to put them in the pit, since in some cases, on gripping, the robot arm inadvertently knocks over the standing bowling pins.

After the second throw, all bowling pins which remain on the lane are pushed into the pit by the pusher. The robot arm subsequently grips the bowling pins out of the pit and the robot arm sets up the bowling pins onto the predefined desired positions on the lane again.

In an embodiment, one can also make do without the previously mentioned pusher. In this case, the control unit can activate the robot arm in a manner such that the robot arm picks up the bowling pins in the horizontal orientation and places them into the pit, whereas the robot arm leaves the bowling pins in the vertical orientation standing. The mentioned activation of the robot can hereby be effected in particular after the first throw of the bowling ball and before the second throw of the bowling ball.

It is further possible for the robot arm to set up the bowling pins which lie in the pit and the bowling pins which are toppled after the second throw, onto the predefined positions and to herein leave the bowling pins which have been left standing on the predefined desired position after the second throw standing. This can lead to a shortening of the time which is necessary for setting up the bowling pins after the second throw.

According to a further embodiment, the object recognition device can be designed for recognising a certain bowling pin from a group of bowling pins. For this, the certain bowling pin preferably comprises a detection feature. Further game variants can be conceived by way of this design of the appliance and of the certain bowling pin. The detection feature can be for example a certain colouring, material selection or shaping of the bowling pin. It is merely important for the object recognition device to be able to recognise the certain bowling pin via the detection feature. For example a "golden bowling pin" can be set up onto the predefined position, for example facing the bowling player in a frontmost position. The user or bowling player in a competition situation can then attempt to knock over the golden bowling pin first of all.

In a further design, one can envisage the object recognition device being designed for detecting a bowling ball and a position of the bowling ball. The object recognition device can further be designed for detecting the robot arm and/or a position of the robot arm and/or an orientation of the robot arm and/or a pivot position (swivel position) of the robot arm. Furthermore, the object recognition device can be designed for detecting the lane, the pit, a ramp (see below) and/or the pusher and/or a human and/or an animal. In a further variant, the object recognition device is in the position of detecting objects on the bowling lane and recognising whether the object is a bowling pin or a bowling ball or not. If the object recognition device recognises that the object is neither the bowling ball nor a bowling pin, and is situated within a safety distance from the robot arm, then the control unit can be designed to switch off the robot arm. In particular, the object recognition device can be designed to recognise humans or animals The control unit can be designed to switch off the robot arm when a human or animal is situated within a safety distance from the robot arm. One can prevent e.g. service personnel and the robot arm from interfering with one another by way of such a safety measure.

Furthermore, the at least one robot arm can be designed for gripping and holding the bowling ball and for moving the bowling ball onto a predefined desired position. Furthermore, a control unit can be designed to activate the robot arm in dependence on the detected position of the bowling ball.

One can envisage the object recognition device being arranged on the robot arm and/or above the robot arm and/or next to the robot arm. The object recognition device can also be arranged on, above, behind, in front of or next to the pindeck or the lane. The exact selection of the position of the object recognition device typically depends on the particular circumstances of the respective bowling lane or lane.

In an embodiment, the control unit is designed to activate the robot arm depending on a current orientation and/or current position of the robot arm. For example, the robot arm can have at least an idle position and a gripping position. The idle position of the robot arm should be designed in a manner such that the robot arm in the idle position does not inhibit a throw of the bowling player or user.

If the robot arm or a bowling pin or the bowling ball should block or restrict the view of the object recognition device, then control unit can activate the robot arm in a manner such that the robot arm moves into another position. Alternatively or additionally, it can be advantageous for the object recognition device to be designed in a traversable manner Should the robot arm block the view of the object recognition device, then the object recognition device can be moved to a position, in which the view is cleared. For this, the object recognition device can be arranged on a traversing (travelling) arrangement. The object recognition device can be moved out of an idle position into at least one measuring position and back. The traversing arrangement can be connected to the control unit and can be activatable/activated by this.

Usually, the robot arm comprises a gripping device for gripping and holding the bowling pin. The gripping device for example is a mechanical, a pneumatic and/or a magnetic gripping device.

The use of a magnetic gripping device has the advantage that an exact gripping is not necessary. Furthermore, concerning a magnetic gripping device, a gripping is usually possible at different gripping points of the bowling pin. For this, the bowling pin should comprise at least one magnet and/or at least a ferromagnetic material such as iron, cobalt or nickel. A mechanical or pneumatic gripping device has the advantage that the bowling pin is grippable in a precise manner, so that a precise setting-up of the bowling pin onto the predefined position is possible. A combination of a magnetic, mechanical and/or pneumatic gripping device is likewise conceivable.

The gripping device can comprise a sensor which is designed for recognising a holding of the bowling pin and/or bowling ball. The sensor of the gripping device in turn can be connected to the control unit. Thus in an embodiment, the robot arm cannot be moved further or rotated further by way of a corresponding control of the control unit until the sensor indicates that the bowling pin or the bowling ball is held by the gripping device of the robot arm.

In a further embodiment, the robot arm or the gripping device can be disassembled in a destruction-free manner for exchanging the robot arm/the gripping device, for another robot arm/another gripping device. If the robot arm or a part such as the gripping device, of the robot arm is defective, then the robot arm can be completely or partly disassembled and the robot arm or the respective part exchanged. The appliance can further comprise at least two robot arms for a trouble-free operation. If one of the robot arms should fail during operation, then bowling pins can still be set up with the other robot arm or the further robot arms. Furthermore, a speed for setting up the bowling pins can be increased should two or more robot arms be present. In an embodiment, the movements of the robot arms and/or of the pusher are synchronised or coordinated with one another by the control unit. E.g. collisions of the robot arms can be prevented by way of this.

The object recognition device comprises for example a sensor, such as a photo sensor, or a laser scanner such as a 3D laser scanner, or a switch button or a camera or a combination of several of the mentioned elements for recognising the at least one bowling pin and/or the bowling ball and/or the robot arm and/or the pit and/or the pusher and/or the ramp and/or a human (see below). Herein, the object recognition device preferably permits a 3D object recognition of the respective objects. Herein, several sensors, laser scanners and/or photo-sensors and/or cameras and/or a combination of one or more 3D laser scanners, cameras and photo-sensors can also be further used.

The control unit can be designed to process or handle signals or data of an aforementioned sensor or of several of the aforementioned sensors (laser scanner, 3D laser scanner, switch button, camera, photo-sensor or a combination) of the object recognition device.

In an embodiment, the robot arm is designed to grip and/or set up bowling pins in a manner engaging over the lane or lanes (extending over the bowling lane(s)). In an embodiment, the robot arm is designed for gripping bowling pins which are located on at least two bowling lanes and/or setting up bowling pins onto at least two different bowling lanes. In particular, the robot arm can grip bowling pins from different bowling lanes, hold them and set them up onto different bowling lanes, successively or in an alternating manner—thus not several bowling pins simultaneously. The term "located" herein as a rule encompasses standing bowling pins and lying bowling pins. For example, the robot arm is dimensionable and/or positionable in a manner such that it can grip bowling pins from different bowling lanes and/or place them onto different lanes. Herein, the person skilled in the art recognises that the specific dimension and/or position of the robot arm depend on the dimensions of the respective bowling lanes. After gripping the bowling pin, the robot arm can hold the bowling pin and subsequently set up or place this onto a certain, desired or predefined position (e.g. onto the bowling lane or into the pit).

In an embodiment, the robot arm is arranged in a stationary manner. The robot arm can be designed e.g. for gripping bowling pins which are located on adjacent bowling lanes and/or for setting up the bowling pin onto one of the adjacent bowling lanes. For example, it is conceivable to position the robot arm between two bowling lanes, so that the robot arm can grip and/or set up bowling pins of both bowling lanes or of adjacent bowling lanes.

In a further embodiment, the robot arm is designed in a traversable manner. For example, one can envisage the robot arm being arranged on or at a traversable vehicle such as a carriage. The vehicle can comprise e.g. wheels, tires or rollers. In this case, the robot arm can be moved in accordance with requirements to that bowling lane, where bowling pins are to be picked up, put in place and/or set up. In this case, the bowling lanes do not need to be adjacent, and one or more bowling lanes can therefore be arranged between these bowling lanes. The vehicle can be moved e.g. by way of a stepper motor, wherein the stepper motor is preferably activated by the control unit.

The appliance can further comprise a position sensor which is connected to the control unit, for recognising a position of the traversable robot arm. The position sensor can hereby be a unit which is different from the object recognition device, such as e.g. a GPS sensor which is fastened to the respective robot arm. The position sensor can also be integrated into the stepper motor. A position/relative position of the vehicle can then be determined by counting the steps of the stepper motor. The position sensor can alternatively also be the object recognition device itself. The control unit can be designed to activate the traversable robot arm in dependence on its actual position and/or to traverse (move) it into a desired position and subsequently activate it.

The stationary or traversable robot arm can also be arranged above the bowling lane or bowling lanes, e.g. at a certain height. In this case, the robot arm grips downwards, in order to take a bowling pin from one of the bowling lanes. For this purpose, the stationary robot arm can be fastened to a carrier which is arranged at a certain height above the bowling lane or bowling lanes. The vehicle of the traversable robot arm can be coupled to a rail or guide (see below) which e.g. is arranged at a certain height above the bowling lane or bowling lanes.

If several robot arms are present, then the control unit can activate this robot arm and/or the respective other robot arm and/or the respective other robot arms, in dependence on an operating state of a robot arm. If for example the robot arm is fully functional or is not functional, then the operating state can be characterised by "good" and "poor" respectively. If the robot arm is not cable of functioning, then the control unit can activate the other robot arm or the other robot arms, so that the other robot arm or the other robot arms assume the functions of the non-functioning robot arm. For example, the control unit can instruct the non-functioning, traversable robot arm or the vehicle of this traversable robot arm or a motor of the vehicle to move to a sidelined position. The control unit can further instruct the non-functioning, stationary robot arm to assume its idle position. Furthermore, the control unit can instruct a functional robot arm to assume the place of the non-functional robot arm and to assume its functions. The operating state can moreover be "on" and "off". If the robot arm e.g. is switched on or off, the further operational state "on" and "off" respectively can be present. In an embodiment, the appliance comprises means for detecting an operational state of the robot arm. The means for detecting the operational state can be connected to the control unit or be part of the control unit. Alternatively or additionally, a user, by way of the aforementioned input means which is connected to the control unit, can specify which operational state the respective robot arm has (thus in particular "on" or "off" as well as "good" or "poor").

Moreover, a bowling system is put forward in this present document. In particular, the bowling system can comprise the previously described appliance for setting up at least one bowling pin and/or the described robot arm or the robot arms. Furthermore, the bowling system comprises an essentially horizontally extending bowling lane.

The bowling system can comprise at least two essentially horizontally extending bowling lanes. Longitudinal axes of the bowling lanes are preferably aligned parallel to one another. In an embodiment, the robot arm is designed to grip and/or set up bowling pins in a manner engaging (extending) over the lane(s). One can envisage the robot arm being designed for gripping bowling pins which are located on the at least two bowling lanes. In an embodiment, the robot arm is arranged in a stationary manner with respect to the bowling lanes, for example above or between two adjacent bowling lanes. In this case, the robot arm can grip the bowling pins which are located on adjacent bowling lanes, e.g. one after the other or alternately. If the robot arm is designed in a traversable manner, then the robot arm can be moved to a position in a manner such that the robot arm can grip and/or set up bowling pins of the adjacent bowling lanes from this position.

The bowling system can comprise a rail or a guide, on which or in which the vehicle is traversable. Hereby, the rail can be part of a rail system. The rail or the guide ensures that the robot arm can only be traversed along a predefined path. In an alternative, the vehicle is movable on a track which is envisaged for this. The track is usually adjacent to the bowling lanes. The track is preferably dimensioned in a manner such that at least two vehicles can travel next to one another in opposite directions without a collision of the two vehicles occurring. The vehicle can be designed in a self-driving manner, i.e. the vehicle can comprise suitable software and hardware, in order to move the robot arm from bowling lane to bowling lane without accidents.

In an embodiment, a ratio of robot arms to bowling lanes is smaller than one. If for example a number of N robot arms and a number of M bowling lanes are present, then N is smaller than M. E.g. a single robot arm can be provided for two bowling lanes. Costs can be reduced with this embodiment.

In another embodiment, a ratio of robot arms to bowling lanes is smaller than one. If for example a number of N robot arms and a number of M bowling lanes are present, then N is larger than M. E.g. two or more robot arms per bowling lane can be provided. In the case, a redundancy can be provided, with which redundancy a trouble-free, interruption-free operation of the bowling system can be ensured. If for example a robot arm of a bowling lane becomes non-functional, then another robot arm can be moved to the respective bowling lane or an adjacent, stationary robot arm can assume the gripping, holding and setting-up of bowling pins of the non-functioning robot arm. In contrast to this, in conventional systems the complete bowling lane is out of service if the respective setting-up appliance is defective. Thus in particular one can operate without any interruptions with the suggested appliance and/or the suggested bowling system. Furthermore, maintenance costs can be lowered by way of the redundancy since less service personal need to be present, in order to ensure an undisturbed, interruption-free operation of the bowling lanes.

The bowling system can comprise a ramp which extends along the bowling lane, wherein the ramp is inclined towards the horizontal, e.g. towards the horizontal of the level bowling lane. The ramp usually comprises a guide rail for a bowling ball, wherein the robot arm is designed to place the bowling ball onto the ramp. The ramp further preferably extends to a ball table. The bowling ball can then roll on the ramp under the influence of its own weight to the ball table, where it can then be used by a user for the next throw.

In the state of the art, one often envisages the bowling ball rolling in front of a ball accelerator after the throw, said accelerator bringing the bowling ball to a high speed and rolling it to a ball depository. The bowling ball is braked in front of the ball depository and is brought back onto a ball table by a conveying belt which is located in a housing of the ball depository. In another variant of the state of the art, a conveying belt and a ball lifter are provided, said ball lifter being connected to the conveying belt and lifting the ball onto a ramp, whereupon the bowling ball rolls on the ramp to the ball table.

One can therefore make do without the complicated construction which is prone to defect (ball accelerator, conveying belt, ball lifter etc.) of the state of the art, by way of the comparatively simple arrangement of the ramp in combination with the robot arm for gripping the bowling ball.

All features of the bowling system can be combined with the features of the appliance and vice versa, inasmuch as these features do not contradict or exclude one another.

Furthermore, a method for setting up at least one bowling pin is put forward in the present document. The method comprises at least the steps:

- detecting the bowling pin and an orientation of the bowling pin, wherein the orientation of the bowling pin encompasses a vertical orientation and a horizontal orientation of the bowling pin;
- gripping the bowling pin by way of a robot arm; and
- setting up the bowling pin onto a predefined desired position by way of the robot arm.

The method can further comprise the following steps:

- detecting a position of the bowling pin, wherein the detected position encompasses a desired position and/or an actual position which is horizontally displaced with respect to the desired position; and
- moving the robot arm depending of the detected position of the bowling pin.

Furthermore, concerning the method, additional steps can be provided:

- detecting a position of a second number of vertically orientated bowling pins;
- pushing a first number of horizontally orientated bowling pins and the second number of vertically orientated bowling pins into a pit;
- gripping the second number of bowling pins out of the pit by way of the robot arm; and
- setting up the bowling pins onto the detected position by way of the robot arm.

In an embodiment of the method, the following steps are realised:

- detecting a bowling ball and a position of the bowling ball;
- gripping and holding the bowling ball by way of the robot arm; and
- moving the bowling ball onto a predefined desired position by way of the robot arm.

The method can comprise the following steps:

- recognising a certain bowling pin from a group of bowling pins, wherein the certain bowling pin comprises a detection feature.

In particular, the method can comprise one or more steps which have been described above on explaining the appliance for setting up bowling pins. The method can be implemented e.g. as a code, for example in the form of a computer program on a computer-readable medium such as a volatile memory or a non-volatile memory.

In particular, the method can be carried out with the aforedescribed appliance for setting up bowling pins. The aforementioned bowling system is likewise suitable for carrying out the described method.

Here, it is to be noted that features which have only been mentioned with regard to the appliance for setting up bowling pins or with regard to the bowling system can also be claimed for the mentioned method for setting up bowling pins and vice versa.

Figure 2:
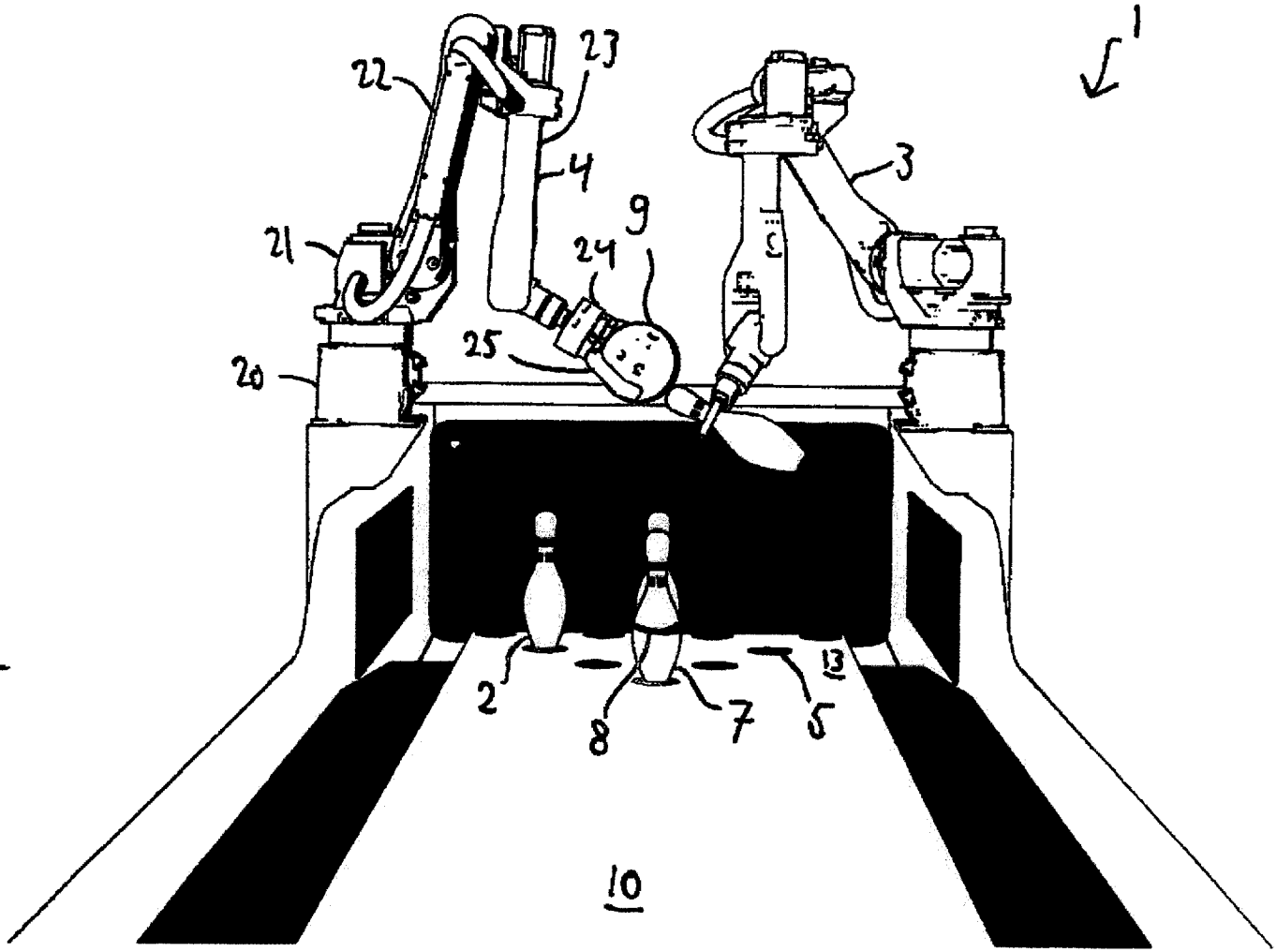
Figure 3:
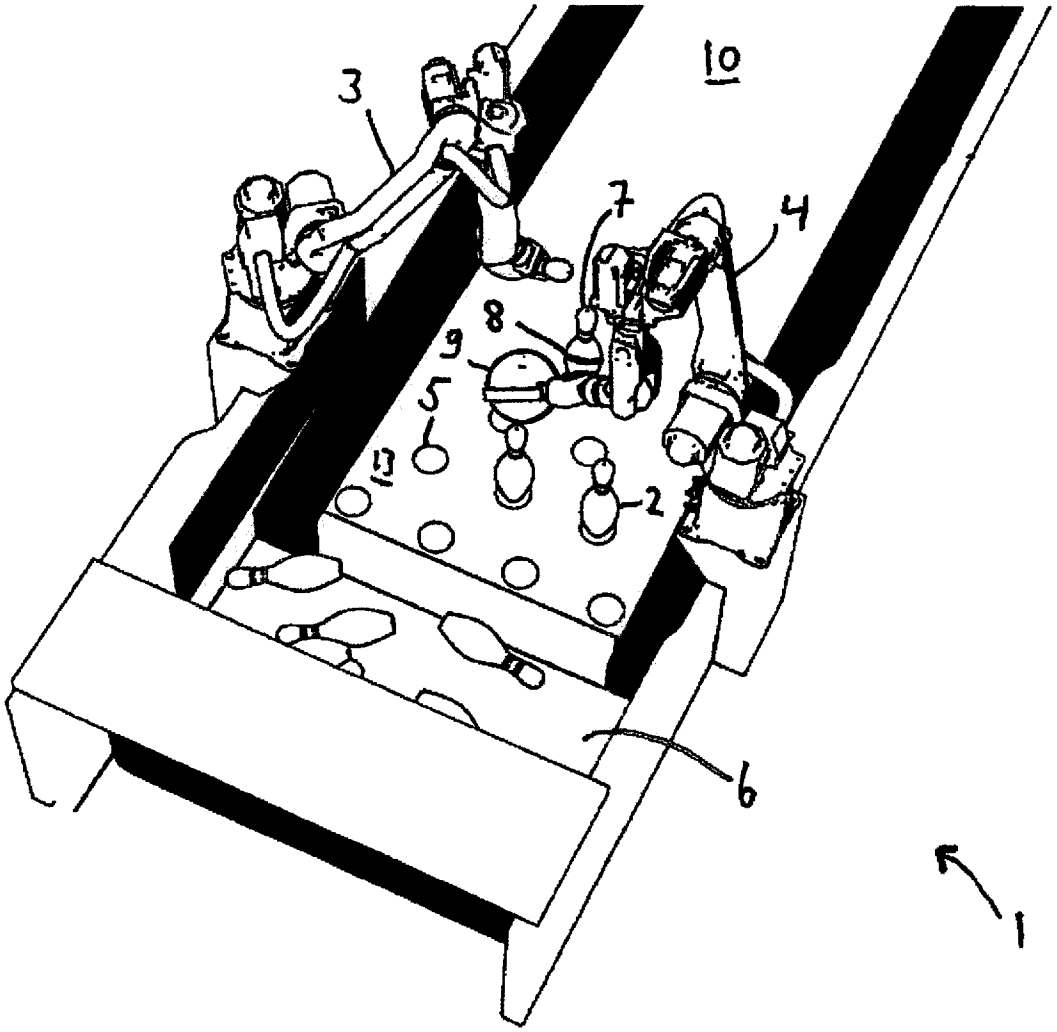
Figure 4:
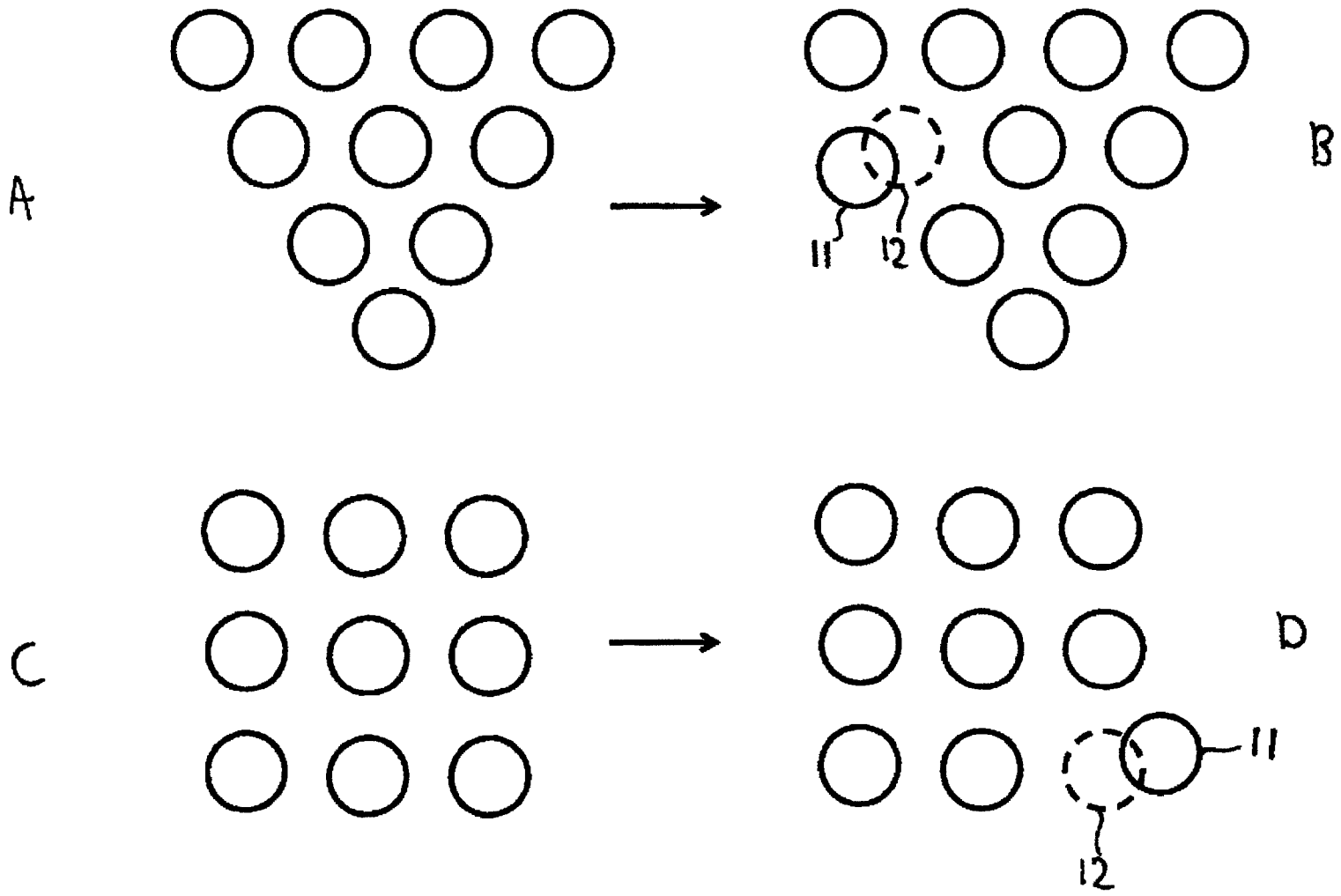
Figure 5:
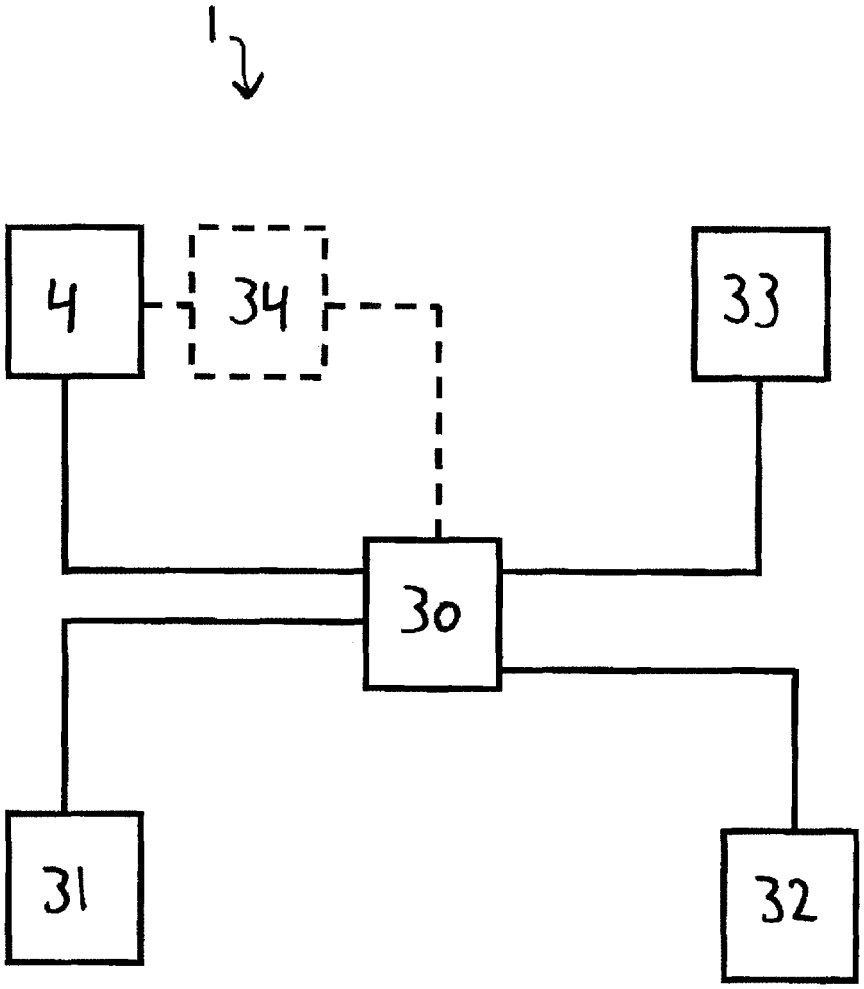
Figure 6:
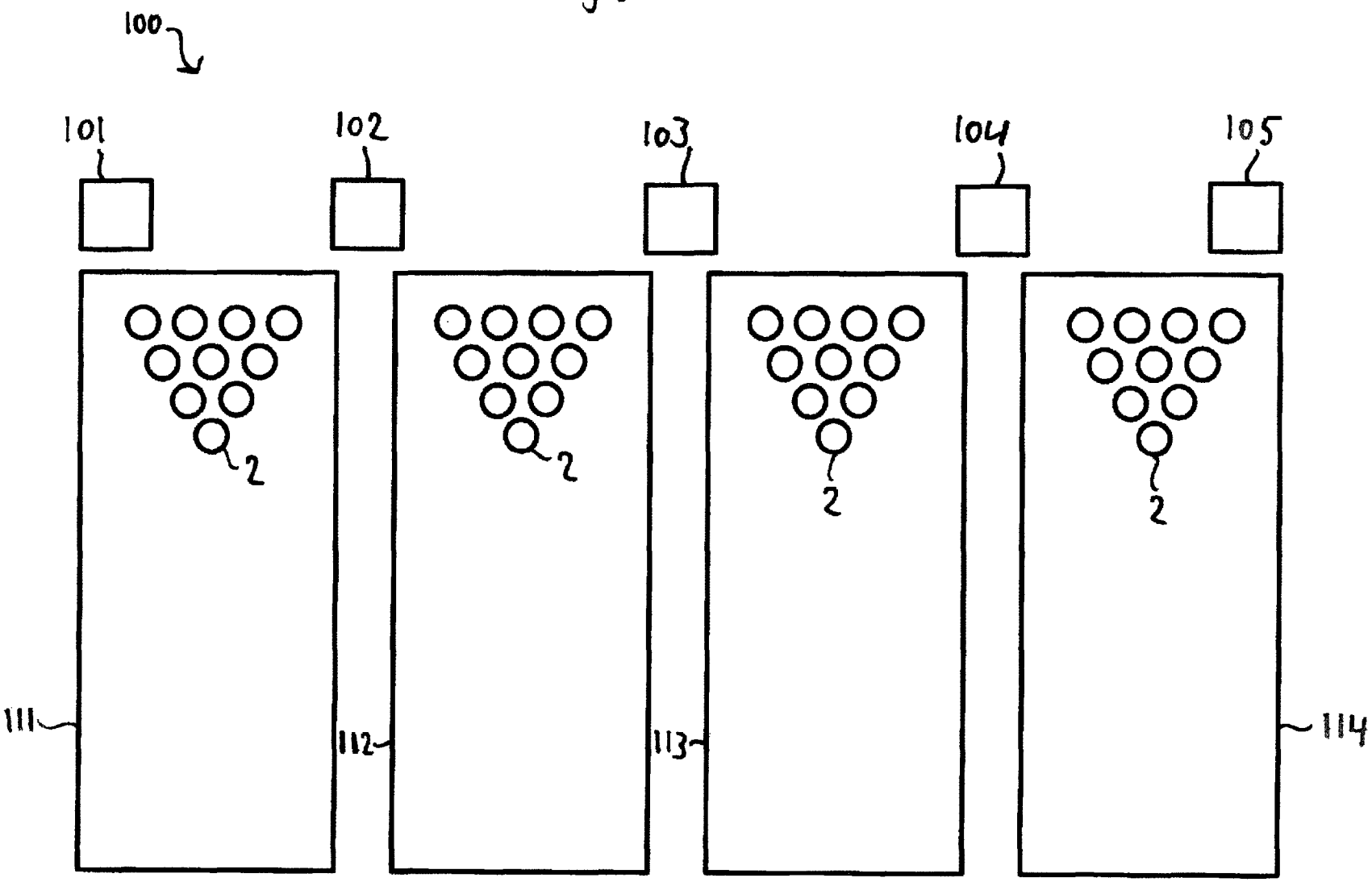
Figure 7:
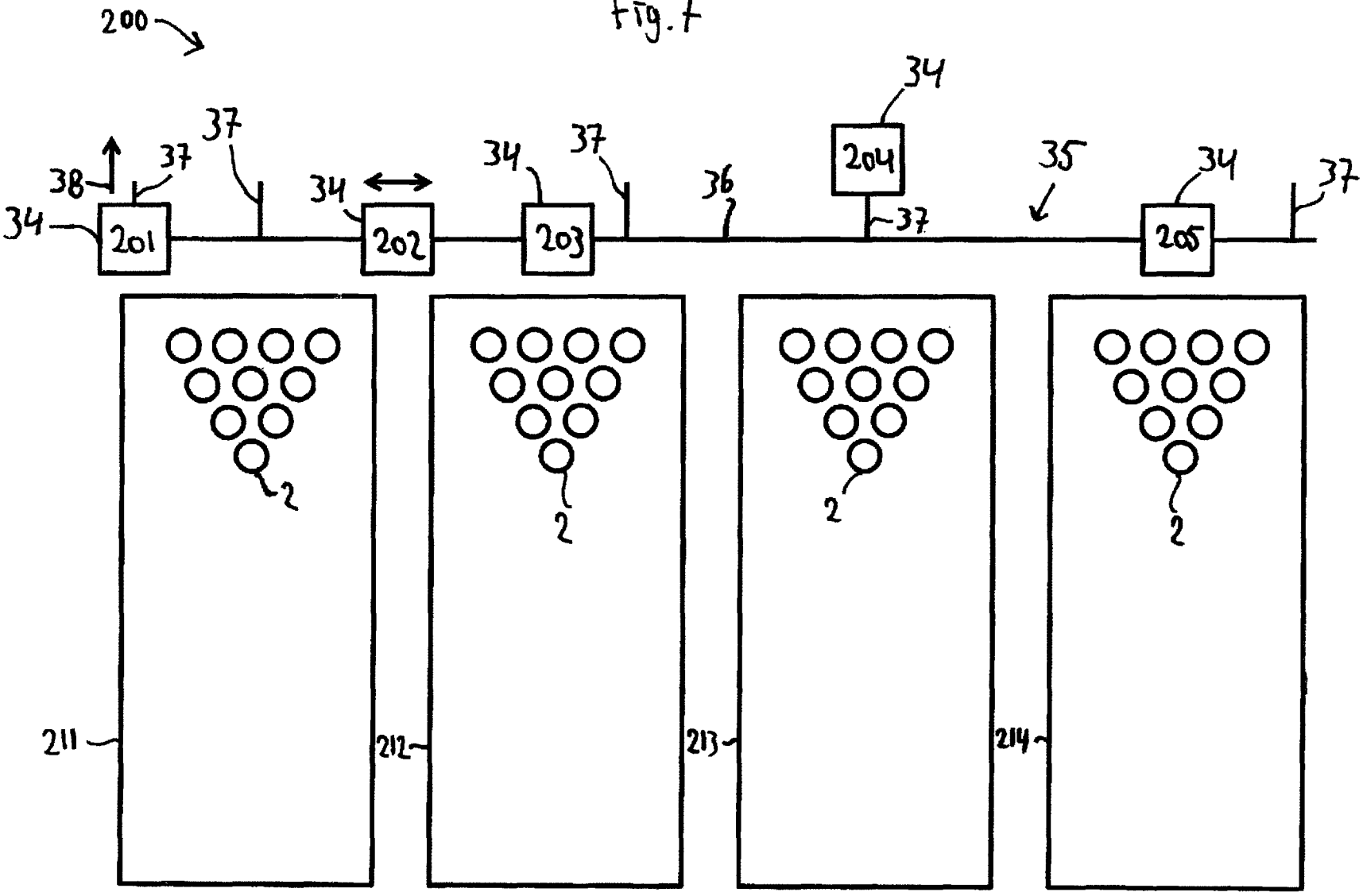

The invention is hereinafter explained by way of the attached figures. In the figures are shown in FIG. 1 a perspective view of an appliance for setting up bowling pins;

FIG. 2 a further view of an appliance for setting up bowling pins;

FIG. 3 a further view of the appliance for setting up bowling pins;

FIG. 4 various desired positions of bowling pins;

FIG. 5 a schematic representation of the appliance for setting up bowling pins according to FIGS. 1-3;

FIG. 6 a schematic representation of a bowling system with several bowling lanes; and FIG. 7 a schematic representation of a further bowling system with several bowling lanes.

In the figures, recurring features are provided with the same reference numerals.

FIGS. 1 to 3 show different views of an appliance 1 for setting up bowling pins 2. The appliance 1 is located at one the end of a level lane 10 which is sometimes also called a run surface 10 or bowling lane 10. What can be recognised are various bowling pins 2 which are set up or can be set up in a region 13, the so-called pindeck 13, of the run lane 10. A deepening 6 which is designed as a pit or gutter 6 and into which toppled bowling pins 2 can be transported is adjacent to the region 13. A pusher can be provided (not represented), said pushed being capable of pushing toppled and/or standing bowling pins 2 from the pindeck 13 into the pit 6. Typically, the bowling pins 2 are toppled over by the bowling ball 9. As a rule, the bowling ball 9 is manufactured from a plastic mass and as a rule has a weight of 3.5 to 7.3 kg. Furthermore, a bowling pin 2 usually weights between 1300 and 1640 grams and is about 35 to 40 cm, e.g. about 38 cm high. The bowling pin 2 mostly has a core of wood which is provided with a plastic coating.

The appliance 1 comprises two robot arms 3, 4 which each weight roughly 100 to 150 kg. One can also provide more than two robot arms or a single robot arm. The robot arms 3, 4 are designed for gripping and holding a bowling pin 2. Furthermore, the robot arms 3, 4 are designed for setting up the bowling pins 2 onto a predefined desired position 5, 12. The robot arms 3, 4 can be multi-axis robots. For this, the robot arms 3, 4 can comprise several arm segments 22, 23, 24. In the shown embodiment example, the robot arms 3, 4 each comprise a base 20, on which a platform 21 is rotatable arranged about a vertical rotation axis. A pivot arm segment 22 is pivotably arranged on the platform 21. A further arm segment 23 which for example can be designed as a rotation arm segment is arranged on the pivot arm segment 22. A gripping arm segment 24 which comprises a rotation axis is arranged on the further arm segment 23. A gripping device 25 which can be moved in space and pivoted via an activation of the movement axes of the robot arm segments 22, 23, 24 can be arranged on the gripper arm segment 24. The gripping device 25 can for example be a pneumatic, mechanical and/or magnetic gripping device. As can be recognised in the FIGS. 1-3, the robot arms 3, 4 are moreover designed for gripping and holding a bowling ball 9. The gripping device 25 can comprise a sensor which is designed for recognising a holding of the bowling pin 2 and/or of the bowling ball 9. The robot arms 3, 4 have at least one idle position and a gripping position. By way of this, one can ensure that the robot arms 3, 4 do not inhibit a throw of a bowling player or of a user of the lane 10.

In the shown embodiment example, the appliance 1 comprises two robot arms 3, 4. Alternatively, one can also envisage only one robot arm or more than two robot arms. The robot arms 3, 4 are preferably of the same type. Alternatively one can also use two different types of robot arms 3, 4 for the appliance 1. The robot arms 3, 4 and/or the gripping devices 25 can each be disassembled in a destruction-free manner, so that they can be partly or completely disassembled in the case of a defect function and be replaced by another robot arm or another gripping device 25.

A non-represented ramp can extend laterally along the bowling lane 10. The ramp can comprise a guide rail for the bowling ball. At least one of the robot arms 3, 4 can be designed to place the bowling ball 9 onto the ramp. The ramp is inclined with respect to the level lane 10, by which means the bowling ball 9 rolls under the influence of its own weight back to the ball table which is positioned at the beginning of the lane 10. Here, the bowling player can remove the bowling ball 9 from the ball table and use it for the next game The appliance 1 further comprises an object recognition device (cf. FIG. 5) which is not represented. The object recognition device is designed for detecting the bowling pin 2 and/or the bowling ball 9 and/or the robot arm 3, 4 and/or the pit 6 and/or the lane 10 and/or a human and/or an animal. The object recognition device can further recognise which orientation the bowling pins 2 have. In other words, the object recognition device is capable of detecting whether a bowling pin 2 is toppled or stands.

The object recognition device can further be designed for detecting a position of the bowling pin 2 on the lane 10. The object recognition device can be arranged for example on the robot arm 3, 4, and/or above the robot arm 3, 4 and/or next to the robot arm 3, 4. For this, the object recognition device can comprise several modules which are arranged at different locations. The object recognition device can be traversably arranged on a traversing arrangement, so that the object recognition device is always in the position of recognising a position and/or orientation of the bowling pin 2. The object recognition device can therefore be traversed (moved) if one of the robot arms 3, 4 should block the view of the object recognition device. The object recognition device can further be designed for detecting the robot arm 3, 4 or parts of the robot arm 3, 4 and/or a position of the robot arm 3, 4 and/or an orientation of the robot arm 3, 4 and/or a pivot position of the robot arm 3, 4.

The object recognition device comprises at least one sensor which detects the bowling pins 2 and/or the bowling ball 9 and/or the robot arm 3, 4. A laser scanner can be used for example as a sensor. Herein, the scanner can emit several laser beams at a small distance, so that a fan of laser beams arises. The fan which is formed by the laser beams is then pivoted by way of pivoting the sensor over a detection region, as a rule at least over the region 13 (pindeck 13) and the pit 6, by which means a spatial detection of the detection region is effected. Herein, geometric data is gathered by way of distance measurement by way of the laser beams. A camera for detecting the bowling pin 2 and/or the bowling ball 9 and/or the robot arm 3, 4 can be used alternatively or additionally to the laser scanner. The object recognition device can comprise one sensor or also a multitude of sensors per bowling lane.

The object recognition device can moreover be designed for recognising a certain bowling pin 7 from a group of bowling pins 2. The certain bowling pin 7 has a detection feature 8 compared to the other bowling pins 2 of the group, said feature being designed as a coloured, circumferential line 8 on the bowling pin 7 in the shown embodiment example.

If the object recognition device recognises that a human or/and animal is situated within a predefined safety distance from the robot 3, 4, then the control unit which is connected to the object recognition device can be designed to switch off the robot arm 3, 4. In this manner, one can ensure that e.g. service personnel and the robot arm 3, 4 do not interfere with one another.

The appliance 1 further comprises a control unit which is not represented (cf. FIG. 5). The control unit is designed to evaluate data and/or signals of the object recognition device, and to activate the robot arms 3, 4 depending on the predefined desired position 5, 12 of the bowling pin 2, 7 and/or on the detected orientation of the bowling pins 2, in order to pick up the bowling pins 2, 7 and to set them up on the bowling lane 10 or place them into the pit 6.

If for example it is detected by the object recognition device that the bowling pins 2 are toppled, then the control unit activates the robot arm 3, 4 in order to set up the bowling pins 2 back onto the predefined desired positions 5. Furthermore, the control unit is usually designed to activate the robot arm 3, 4 depending on the detected position of the bowling pin 2, wherein the detected position comprises a desired position 5, 12 and/or an actual position 11 which is horizontally displaced with respect to the desired position 5, 12. Furthermore, the control unit can be designed to grip the robot arms 3, 4 depending on the detected position of the bowling ball 9, in order to grip the bowling ball 9.

It can occur that a bowling pin 2, 7 is displaced from its initial position with the first throw, without toppling. This case is outlined in FIGS. 4B and 4D. The desired position 12 is represented in FIGS. 4B and 4D as a dashed line. After a first throw of a bowling player or a user of the lane 10, the bowling pin 2 is displaced to a new position 11 by the bowling ball 9 or by another bowling pin 2 without herein toppling over. This displaced position 11 of the bowling pin 2, 7 is detected by the object recognition device and is transferred to the control unit. However, before the second throw, the bowling pin 2, 7 should stand there, thus at the displaced position 11, to where it was pushed given the first throw. With the second throw, one can ensure that the bowling pin 2, 7 is set up or remains standing, precisely at where it was pushed to after the first throw, due to the fact that the control unit 3, 4 is capable of activating the robot arm 3, 4 depending on the detected position of the bowling pin 2, 7.

As a rule, the control unit is connected to the pusher (cf. FIG. 5), in order to activate this. The control unit can be designed to activate the pusher and the robot arm 3, 4 in a manner such that if a first number of bowling pins 2, 7 has toppled, the pusher pushes all bowling pins 2, 7 including the second number of standing bowling pins 2 into the pit 6. In contrast to the state of the art where standing bowling pins 2 are lifted from the pindeck and it is only the toppled bowling pins are pushed into the pit, according to the present application all bowling pins 2 which are located on the pindeck 13 are pushed into the pit 6. The robot arm 3, 4 subsequently grips bowling pins 2 out of the pit 6 and sets up the bowling pins 2 onto the positions 5, 11 of the bowling pins 2 which are detected by the object recognition device.

Alternatively, one can make do without the previously mentioned pusher. In this case, the control unit can activate the robot arms 3, 4 in a manner such that the robot arms 3, 4 collect up the toppled bowling pins 2, 7 from the bowling lane 10 and transport them into the pit 6, whilst the robot arms 3, 4 leave the standing bowling pins 2, 7 standing on the bowling lane 10. In particular, the mentioned activation of the robot arms 3, 4 can be effected after the first throw of the bowling ball 9 and before the second throw of the bowling ball 9.

The control unit can be designed to activate the robot arms 3, 4 depending on their current orientations and positions. In particular, it is advantageous if movements of the robot arms 3, 4 and of the pusher are synchronised or coordinated with one another by way of the control unit. The control unit can activate the robot arms 3, 4 so that they move into the idle position. Furthermore, the robot arms 3, 4 can be activated in order to improve a recognition of the bowling pin 2 and of the bowling ball 9 by the object recognition device. The control unit can further activate the traversing arrangement of the object recognition device.

In a further variant, the control unit is connected to the sensor of the gripping device.

The control unit can comprise a microcontroller, a processor, a microprocessor and/or a digital signal processor for the processing and/or handling of the signals and/or of the data of the aforementioned sensors. Hereby, a digital signal processor (DSP) can be designed for a continuous processing of digital signals, for example digital signals of the aforementioned sensors. One can further envisage the control unit being designed to activate one or more of the mentioned sensors.

Furthermore, the control unit can comprise one or more memories, such as e.g. random access memory (RAM), read only memory (ROM), a hard disc, a magnetic storage medium and/or an optical drive. A program, e.g. software for processing or handling the data and/or the signals of a sensor or several of the aforementioned sensors can be stored in the memory.

Furthermore, an input means which has not been represented (cf. FIG. 5) and which is connected to the control unit can be provided. A user can specify the predefined desired position 5, 12 of the bowling pins 2, 7 or a predefined arrangement of the bowling pins 2, 7 (triangle, rectangle, rhombus, line, shaped line etc.) on the lane and forward it to the control unit via the input means. The control unit and the input means can be connected to one another e.g. optically by way of glass fibres, electrically by way of cables or via a wireless communications device.

Different arrangement possibilities of bowling pins 2, 7 are shown in FIG. 4. According to FIG. 4A, ten bowling pins 2, 7, 12 are arranged into an isosceles triangle. FIG. 4C shows an arrangement of nine bowling pins in a square. Of course, many different arrangements of bowling pins 2, 7, 12 are possible and the present application is not limited to a certain arrangement of bowling pins 2, 7.

A method for setting up at least one bowling pin 2, 7 is provided by the present document. The method comprises the steps:

- detecting the bowling pin 2, 7 and an orientation of the bowling pin 2, 7, wherein the orientation of the bowling pin 2, 7 comprises a vertical orientation and a horizontal orientation of the bowling pin 2, 7;
- gripping the bowling pin 2, 7 by way of a robot arm 3, 4; and
- setting up the bowling pin 2, 7 onto a predefined desired position by way of the robot arm 3, 4.

The method can comprise further steps:

- detecting a position of the bowling pin 2, 7, wherein the detected position comprises a desired position and/or an actual position which is horizontally displaced with respect to the desired position; and
- moving the robot arm 3, 4 depending on the detected position of the bowling pin 2, 7, Furthermore, additional steps can be envisaged by the method:

- detecting a position of a second number of vertically orientated bowling pins 2, 7;
- pushing toppled bowling pins 2, 7 and standing bowling pins 2, 7 into a pit 6;
- gripping bowling pins 2, 7 out of the pit 6 by way of the robot arm 3, 4; and
- setting up the bowling pins 2, 7 onto the detected position 11 by way of the robot arm 3, 4.

In particular, the described method can be carried out with the appliance 1 which is described above.

FIG. 5 shows a schematic representation of the appliance 1 for setting up bowling pins 1. It is to be recognised in FIG. 5 that the control unit 30 is connected to the object recognition device 31, to the input means 32, to the pusher 33 and to the robot arm 4. Furthermore, in FIG. 5, by way of dashed lines it is indicated that the control unit 30 is connected to a stepper motor of a vehicle 34 (see below). The control unit 30 and the object recognition device 31, the input means 32, the pusher 33, the robot arm 4 and/or the stepper motor of the vehicle 34 can each be connected to one another e.g. optically by way of glass fibres, electrically by way of cables or via a wireless communication device.

An operating state of the robot arm 3, 4 can be communicated to the control unit 30 via the input means 32. If one of the robot arms 3, 4 is no longer functioning due to a defect, then the operating state ""non-functional" or "poor" can be inputted e.g. at the input means 32. The control unit 30 then activates the respective other robot ram 3, 4 in dependence on this operational state, so that the other robot arm 3, 4 assumes the functions of the non-functioning robot arm 3, 4. The input means 32 can be e.g. a keyboard, a mouse, a touchscreen, a handy such as a smartphone, or the like. It is to be understood that the invention is not limited to a certain input means 32. Alternatively or additionally, means (not represented) for detecting an operational state of the robot arm 3, 4 can be provided, said means displaying which operational state the respective robot arm 3, 4 has. These detection means can also be connected to the control unit 30 in the manner described above.

FIG. 6 shows a schematic representation of a bowling system 100 with several bowling lanes (lanes) 111, 112, 113, 114, whose longitudinal axes are aligned parallel to one another. Four bowling lanes 111, 112, 113, 114 are shown in the represented example. Of course, more or less than four bowling lanes can be provided. The bowling system 100 comprises five robot arms 101, 102, 103, 104, 105 which are arranged in a stationary manner with respect to the bowling lanes 111, 112, 113, 114. For example, at least the robot arms 102, 103, 104 are arranged between the bowling lanes 111, 112, 113, 114. The robot arms 101, 102, 103, 104, 105 can each be fastened to a non-represented carrier which is located at a certain height above the bowling lanes 111, 112, 113, 114. The robot arms 101, 102, 103, 104, 105 are all connected to the control unit. 30. The control unit 30 can therefore activate the robot arms 101, 102, 103, 104, 105 individually and coordinate the operational sequence of the robot arms. The middle three robot arms 102, 103, 104 are each designed for gripping, holding and setting up bowling pins 2 which are located on two adjacent bowling lanes. For example, if robot arms 101 and 103 should fail due to a malfunction, the bowling pins 2 of the bowling lanes 111, 112 can be gripped and set up by the robot arm 102. By way of the provision of redundant robot arms, it can be ensured that the bowling lanes 111, 112, 113, 114 can also be played on if one robot arm or several robot arms have broken down and need to be repaired. Alternatively, one can also make do without robot arms 101, 103, 105 in order to lower costs. In this case, the robot arms 102 and 104 can pick up and set up the bowling pins 2 of the lanes 111, 112 and 113, 114 respectively, in a manner engaging over the lane.

FIG. 7 shows a schematic representation of a further bowling system 200 with several bowling lanes (lanes) 211, 212, 213, 214 which run parallel to one another. The bowling system 200 differs from the bowling system 100 in that a rail system 35 and traversable robot arms 201, 202, 203, 204 and 205 are provided. Alternatively, the bowling system 200 can also comprise one or more guides for the robot arms 201, 202, 203, 204, 205. The robot arms 201, 202, 203, 204, 205 which are connected to the control unit 30 are each arranged on a traversable vehicle 34. The vehicles 34 comprise wheels, tires or rollers and are assembled on the rail system 35, wherein the rail system 35 can be positioned at the same height as the bowling lanes 211, 212, 213, 214 (e.g. next to the bowling lanes) or also at a certain height above the bowling lanes 211, 212, 213, 214. The rail system 35 comprises e.g. a main rail 36 which runs transversely to a longitudinal axis of the respective bowling lane 211, 212, 213, 214, and five siding rails 37 which extend parallel to the longitudinal axes of the bowling lanes 211, 212, 213, 214 and are connected to the main rail 36.

In FIG. 7 it is indicated that the robot arm 204 is located on the siding rail 37. If for example it is ascertained that the robot arm 201 is non-functional according to the operating state "poor", then the control unit 30 can initiate the robot arm 201 into travelling to one of the siding rails 37 and to subsequently switch it off according to the operating state "off" and "poor". This is represented in FIG. 7 by the arrow 38. The now absent robot arm 201 can be compensated by traversing the robot arm 202 on the main rail 36. Position sensors for recognising a position of the traversable robots arms 201, 202, 203, 204, 205 can be provided so that the control unit 30 knows where the individual robot arms or vehicles 34 are located. The respective position sensors can be fastened e.g. to the robot arms 201, 202, 203, 204, 205 or a constituent of the stepper motors. Alternatively, the object recognition device 33 is used for the detection of the positions of the robot arms 201, 202, 203, 204, 205. The control unit 30 then controls the robot arms 201, 202, 203, 204, 205 or the stepper motors of the vehicles 34 of the robot arms 201, 202, 203, 204, 205 in dependence on their position.

In the shown embodiment example, the bowling lane 213 is not played on at the present time. For this reason, the associated robot arm 204 was traversed onto the siding rail 37 and temporally switched off by way of activating the control unit 30. In the shown example, its operating state is therefore "good" and "off". The further robot arms 202, 203 and 205 each have the operating state "good" and "on".

In a further embodiment, the vehicle 34 is traversable on a track (not represented) which is envisaged for this. The track is usually adjacent to the bowling lanes 211, 212, 213, 214. The track can have e.g. a similar or the same course as the rail system 35 which is shown in FIG. 7. The track is preferably dimensioned in a manner such that at least two vehicles 34 can be moved next to one another in opposite directions without collisions of the two vehicles 34 occurring. In this case, the vehicle can be designed in a self-driving manner, i.e. the vehicle 34 can comprise suitable software and hardware, in order to move the robot arm 201, 202, 203, 204, 205 from one of the bowling lanes 211, 212, 213, 214 to one of the other bowling lanes 211, 212, 213, 214 without any accidents.

Here, it is to be emphasised that features of the aforementioned bowling systems 100, 200 can be combined with features of the appliance 1 or with features of the aforementioned method and vice versa, inasmuch as these features do not mutually contradict or exclude one another.

LIST OF REFERENCE NUMERALS

1 appliance for setting up bowling pins
2 bowling pin
3 robot arm
4 robot arm
5 desired position
6 pit
7 certain bowling pin
8 detection feature
9 bowling ball
10 lane
11 displaced position
12 desired position
13 pindeck
20 base
21 stand
22 pivot arm segment
23 further arm segment
24 gripping arm segment
25 gripping device
30 control unit
31 object recognition device
32 input means
33 pusher
34 vehicle
35 rail system
36 main rail
37 siding rail
38 arrow
100 bowling system
101 robot arm
102 robot arm
103 robot arm
104 robot arm
105 robot arm
111 bowling lane
112 bowling lane
113 bowling lane
114 bowling lane

200 bowling system
201 robot arm
202 robot arm
203 robot arm
204 robot arm
205 robot arm
211 bowling lane
121 bowling lane
213 bowling lane
214 bowling lane

The invention claimed is:

1. An appliance for setting up at least one bowling pin, comprising:

an object recognition device detecting the at least one bowling pin and an orientation of the at least one bowling pin, wherein the orientation of the at least one bowling pin encompasses a vertical orientation and a horizontal orientation of the at least one bowling pin, a robot arm gripping and holding the at least one bowling pin and setting up the at least one bowling pin onto a predefined desired position, a control unit evaluating data and/or signals from the object recognition device and activating the robot arm in dependence on the predefined desired position of the at least one bowling pin and/or on the detected orientation of the at least one bowling pin, the object recognition device detecting a position of the at least one bowling pin and the control unit activating the robot arm in dependence on the detected position of the at least one bowling pin, wherein the detected position includes an actual position which is horizontally displaced with respect to the predefined desired position, the control unit activating the robot arm such that when a first number of the bowling pins has the horizontal orientation detected by the object recognition device, all bowling pins including the first number of the bowling pins in the horizontal orientation are moved and a second number of vertically orientated bowling pins are moved into the horizontal orientation, and the robot arm only grips the second number of bowling pins and returns the second number of bowling pins up into the actual position horizontally displaced with respect to the predefined desired position and returned into the vertical orientation, and a pusher controlled by the control unit, the pusher pushing all of the bowling pins into the pit, including pushing the first number of the bowling pins in the horizontal orientation into the pit and pushing the second number of vertically orientated bowling pins into the horizontal orientation and into the pit.

2. The appliance according to claim 1, wherein the robot arm grips and/or sets up the at least one bowling pin in a manner engaging over bowling lanes.

3. The appliance according to claim 2, wherein the robot arm is arranged in a stationary manner for gripping the at least one bowling pin which is located on adjacent ones of the bowling lanes.

4. The appliance according to claim 1, wherein the robot arm is arranged on a vehicle for transverse movement with respect to bowling lanes.

5. The appliance according to claim 1, further comprising a position sensor connected to the control unit, for recognising a position of the traversable robot arm, wherein the control unit activates the traversable robot arm in dependence on its position.

6. The appliance according to claim 1, wherein the object recognition device recognizes an identifier feature located on a certain bowling pin from a group of the at least one bowling pins.

7. The appliance according to claim 1, wherein the object recognition device detects a bowling ball and a position of the bowling ball, the robot arm grips and holds the bowling ball and moves the bowling ball onto a predefined desired position, the control unit activates the robot arm in dependence on the detected position of the bowling ball.

8. The appliance according to claim 1, wherein the object recognition device is arranged on the robot arm and/or above and/or next to the robot arm.

9. The appliance according to claim 1, wherein the robot arm includes at least one idle position and one gripping position.

10. The appliance according to claim 1, wherein there are two robot arms.

11. The appliance according to claim 10, wherein the control unit, in dependence on an operating state of the robot arm, activates the robot arm and/or a respective other robot arm.

12. The appliance according to claim 1, wherein the object recognition device includes a sensor, a laser scanner, a switch button or a camera.

13. A bowling system, comprising the appliance according to claim 1 and a bowling lane which extends essentially horizontally.

14. The bowling system according to claim 13, further comprising at least two essentially horizontally extending bowling lanes, and wherein the robot arm grips and/or sets up the at least one bowling pin from over the bowling lanes.

15. The bowling system according to claim 14, further comprising a traversable vehicle, wherein the robot arm is arranged on the traversable vehicle.

16. The bowling system according to claim 15, further comprising at least one rail or guide, on which the traversable vehicle is traversed.

17. The bowling system according to claim 14, wherein the robot arm is arranged in a stationary manner with respect to the bowling lanes.

18. The bowling system according to claim 13, wherein a ratio of robot arms to bowling lanes is smaller than one.

19. The bowling system according to claim 13, wherein a ratio of robot arms to bowling lanes is larger than one.

20. The bowling system according to claim 13, further comprising a ramp which extends along the bowling lane, wherein the ramp is inclined towards the horizontal and includes a guide rail for a bowling ball, wherein the robot arm places the bowling ball onto the ramp.

* * * * *